United States Patent [19]

Nagel

[11] 3,930,356

[45] Jan. 6, 1976

[54] METHOD AND APPARATUS FOR INFLUENCING THE AMBIENT CONDITIONS DURING OPEN-END SPINNING

[75] Inventor: Ernst Nagel, Oensingen, Switzerland

[73] Assignee: Luwa AG, Zurich, Switzerland

[22] Filed: Dec. 3, 1971

[21] Appl. No.: 204,430

[30] Foreign Application Priority Data

Dec. 8, 1970 Switzerland ..... 18245/70

[52] U.S. Cl. ..... 57/58.95; 57/156

[51] Int. Cl.[2] ..... D01H 1/12; D01H 13/28

[58] Field of Search ..... 57/58.89–58.95, 156, 34 R; 308/76, 77; 312/236

[56] References Cited

UNITED STATES PATENTS

| | | | |
|---|---|---|---|
| 2,352,206 | 6/1944 | Kendall | 308/77 |
| 2,733,001 | 1/1956 | McDonald | 308/77 X |
| 3,149,819 | 9/1964 | Baumann et al. | 308/77 X |
| 3,457,716 | 7/1969 | Storek et al. | 57/58.89 |
| 3,557,542 | 1/1971 | Oskin et al. | 57/58.89 |
| 3,604,194 | 9/1971 | Edagawa et al. | 57/58.89 |

FOREIGN PATENTS OR APPLICATIONS

| | | | |
|---|---|---|---|
| 1,913,728 | 10/1970 | Germany | 57/58.89 |

*Primary Examiner*—Richard C. Queisser
*Assistant Examiner*—Charles Gorenstein
*Attorney, Agent, or Firm*—Werner W. Kleeman

[57] ABSTRACT

A method and apparatus for influencing the ambient or surrounding conditions during open-end spinning, wherein the fibers are delivered to a spinning rotor or turbine by means of a conveying air stream and then spun into a yarn in such spinning rotor. The invention contemplates cooling the spinning rotor by providing a simultaneously flowing stream of cooling air which is separate from the conveying air stream. The apparatus aspects of this development contemplate disposing the side of the spinning rotor not impinged by the fiber material-conveying air stream in a compartment having inflow- and outflow openings for the cooling air stream. The outflow opening is operatively connected in flow communication with an air conveying device.

12 Claims, 1 Drawing Figure

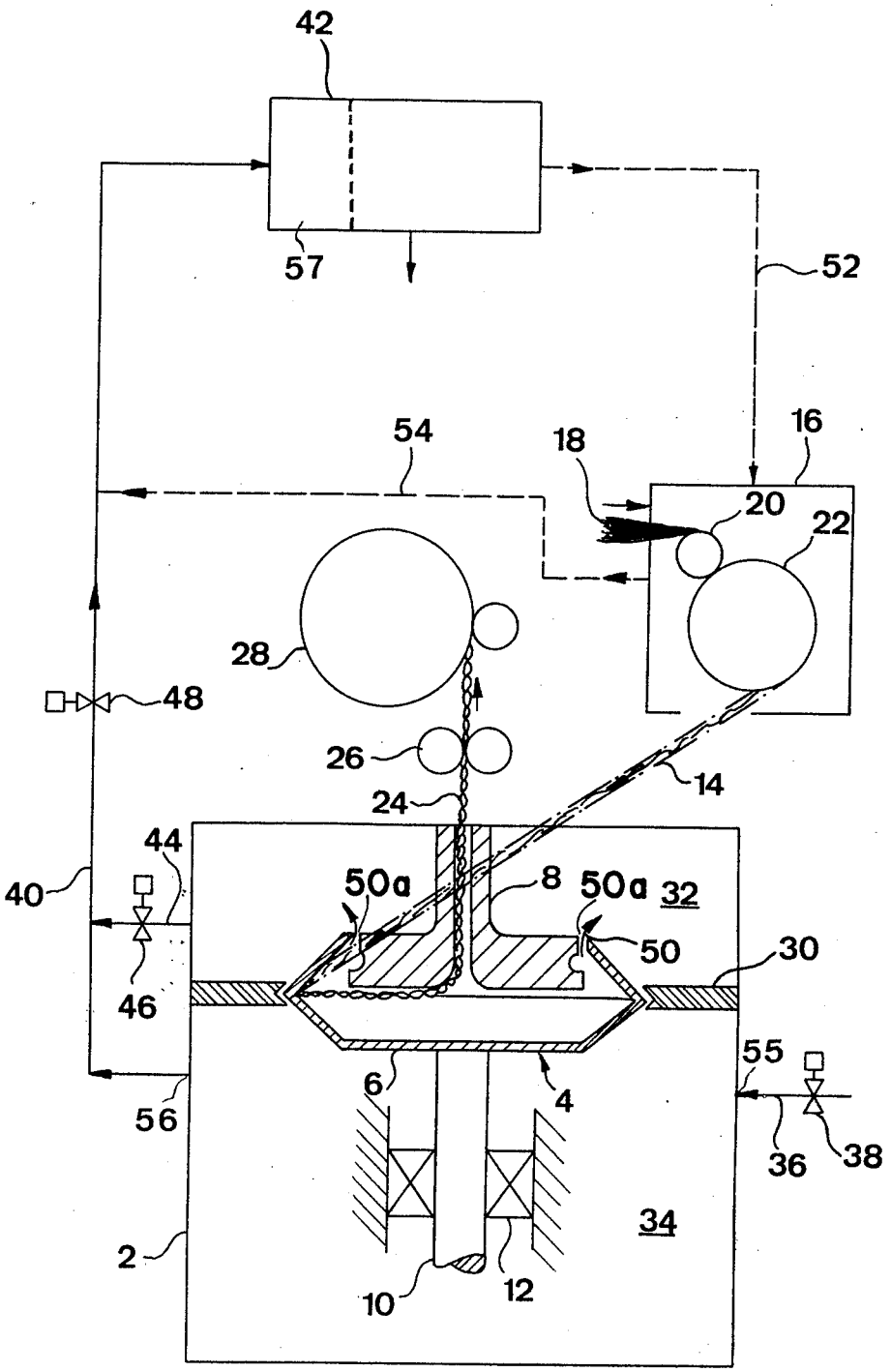
INVENTOR
BY
ATTORNEY

METHOD AND APPARATUS FOR INFLUENCING THE AMBIENT CONDITIONS DURING OPEN-END SPINNING

BACKGROUND OF THE INVENTION

The present invention relates to a new and improved method for influencing the ambient or surrounding conditions during open-end spinning as well as to a new and improved apparatus for the performance of the aforesaid method.

Practical experience gained since the introduction of open-end spinning has shown that after commencing the spinning operation during a certain time period the number of yarn ruptures increases in an inexplainable manner. The determination that the number of yarn ruptures was relatively small at the start of the spinning operation led to the assumption that the cause of the increase in yarn rupture probably was attributable to the increasing contamination or soiling of the working surfaces of the spinning rotor or turbine. However, this assumption has not proven itself to be correct, although relatively frequent periodic cleaning of such working surfaces did bring with it a limited improvement. On the other hand, this pnenomenon cannot be prevented even by changing within permissible limits the climatic conditions of the spinning room with regard to temperature and humidity, quite apart from the fact that the number of yarn ruptures increases notwithstanding constant climatic conditions of the room, in other words, apparently the number of yarn ruptures increases independently of the climatic conditions.

SUMMARY OF THE INVENTION

Now the present invention is predicated upon the recognition that the ambient climatic conditions at the spinning location need not be identical with the climatic conditions of the room and that such ambient conditions, if the aforementioned drawbacks are to be avoided, should be influenced or maintained under control independently of the room climatic conditions or in addition to such.

Hence, it is a primary objective of the present invention to avoid the previously discussed disadvantages arising during open-end spinning when working with state-of-the-art equipment and procedures.

Another and more specific object of the present invention relates to a novel method of, and apparatus for, open-end spinning affording a significant reduction in yarn rupture during yarn spinning.

Still a further significant object of the present invention relates to a novel method of, and apparatus for, carrying out open-end spinning techniques wherein the ambient conditions at the spinning location are controlled or influenced in such a manner as to favorably counteract yarn rupture.

A further significant object of the present invention relates to a novel apparatus for use in open-end spinning techniques wherein mechanism is provided for controllably influencing the ambient conditions at the spinning location to mitigate against yarn rupture during the yarn spinning operations.

Now, in order to implement these and still further objects of the invention, which will become more readily apparent as the description proceeds, the inventive method for influencing the ambient conditions during open-end spinning wherein the textile or spinning fibers are transported by means of a conveying air stream to a spinning rotor or turbine and are spun into a yarn in such rotor, is manifested by the features that the spinning rotor is cooled and such cooling is undertaken by a cooling air stream flowing simultaneously with the fiber material-conveying air stream but separated from such conveying air stream.

By virtue of the inventive method, there is taken into account that, owing to the high rotational speeds of the spinning rotor required during open-end spinning, considerable frictional heat is developed. This frictional heat which is only partially withdrawn by the air in the room, causes a temperature increase of the machine components at the spinning location. This temperature increase results in the fibers, which come into contact with such heated machine components or which are thus guided through a heated work zone, being subjected to an undesired loss in moisture, adversely affecting the quality of the spun yarn.

Due to guiding of the cooling air stream separately from the fiber conveying air stream at the working region or zone, it is possible to prevent a change or impairment of the natural flow structure of the fibers to the spinning zone. It would of course also be possible, in addition to cooling of the spinning rotor, to act directly upon the climatic conditions of the air transporting the fibers to the rotor, i.e. without detour by means of the climatic conditions of the room, in order to obtain optimum climatic conditions at the spinning zone.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE schematically illustrates an exemplary embodiment of inventive apparatus suitable for carrying out the inventive method.

DETAILED DESCRIPTION OF THE PREFERRED EMBODIMENTS

Describing now the drawing, it is to be understood that the single FIGURE schematically depicts a preferred constructional form of inventive apparatus for influencing the ambient or surrounding conditions during open-end spinning, and wherein specifically there is provided a housing 2 containing a spinning rotor or turbine, generally designated in its entirety by reference character 4. This spinning rotor or turbine 4 comprises a driven rotating rotor component 6 and a stationary yarn removal or withdrawal component 8. The rotating rotor component 6 is supported at its shaft 10 in a bearing arrangement 12. A fiber delivery or infeed conduit 14 piercingly extends through the housing 2, delivery conduit 14 supplying the textile or spinning fibers, furnished by a suitable separating mechanism 16, to the rotating rotor component 6 of the spinning rotor 4. A schematically depicted fiber arrangement or structure 18 is shown delivered to the separating mechanism 16 and the latter, as is well known, embodies a delivery or feed cylinder 20 and a combing cylinder 22.

The yarn 24 formed in the spinning rotor 4 is withdrawn from the stationary yarn withdrawal or removal component 8 by means of yarn withdrawal cylinders or rolls 26. This yarn 24 is then wound onto a spool 28 or the like.

Considering again the housing 2, it will be recognized that such contains a separation or partition wall 30 which encloses the rotating rotor component 6 at the region of its greatest circumference or periphery and forms together therewith two compartments or chambers 32 and 34 separated from one another. Compartment 34 is connected at its inflow or infeed opening, schematically indicated at reference character 55, with an infeed line or conduit 36 controlled by throttle 38, the end of this conduit 36, if desired, can be open with regard to the spinning room at a location spaced from the spinning machine. A conduit or line 40 is connected with the outflow or outfeed opening 56 of compartment 34, leads out of this compartment 34 and communicates with a conventional central air-conditioning unit 42 serving for conditioning the room air of the spinning room. The air-conditioning unit 42 embodies any suitable air conveying mechanism, such as a standard blower or ventilator, schematically indicated by reference character 57, the suction side of which is in flow communication with the suction line or conduit 40. On the other hand, the compartment or chamber 32 is connected via a conduit 44 with suction line or outflow conduit 40. Conduit 44 contains a suitable throttle 46. A further throttle 48 is provided at the section of the conduit 40 located between the mouth of the conduit 44 and the central air-conditioning unit 42.

During operation air is sucked out of the compartment 34 by means of the central air-conditioning unit 42 and its air conveying mechanism 57 via the outflow conduit 40, whereas room air can flow via the inflow conduit 36 into the compartment 34. In so doing, a suction air stream which traverses the compartment 34 is formed therein, this suction air stream on the one hand flowing around the turbine 6 and the shaft 10 and, on the other hand, around the bearing arrangement 12, thereby in particular removing any heat resulting because of bearing friction. By adjustment of the throttle 38 as well as, if desired, by the throttle 48 the cooling air stream is regulated such that all of the heat which arises can be withdrawn and there is prevented an increase in the temperature at or in the spinning rotor 4. On the other hand, the conduit 44 ensures for the removal of that air from the compartment 32 which assists the fiber transport in the delivery conduit 14 during operation of the spinning rotor 4 and after arriving at said rotor escapes in the direction of the arrows 50 out of such rotor via the outlet openings 50*a*.

The throttle 46 in conjunction with the throttles 48 and 36 enable influencing the flow conditions in the conduit 44 in such a manner that there can be prevented disturbance of the flow conditions in the rotor itself. Although the air flowing through the fiber delivery or infeed conduit 14 of course can be employed for cooling the rotor it must be taken into consideration that this air, upon wipingly moving past the bearing locations of the delivery cylinder 20 and the combing cylinder 22 can possess a temperature greater than the room temperature. Therefore, it can be advantageous to deliver to the fiber separating mechanism 16, by means of the phantom line illustrated blower air conduit 52, suitably climatized or artificially conditioned air from the central air-conditioning unit 42. The temperature and/or humidity thereof can be, if desired, lower or greater, respectively, than the temperature and humidity or moisture content of the room air.

Now in order to prevent that contaminants or foreign particles are entrained by the delivery conduit 14 into the spinning rotor 4, and which contaminants are released at the separation mechanism 16, it is possible to connect the separation mechanism 16 via a conduit 54 with the suction conduit 40 so that these contaminants are sucked-up into the central air conditioning unit 42 and at that location separated-out by means of any suitable filtering device, not particularly illustrated, and which simultaneously also engages the fibers and contaminants which depart from the spinning rotor 4 by means of the air stream 50.

Of course it is also possible to deliver to the compartment 34 a supply of air which does not come directly from the spinning room, for instance by connecting the conduit 36 with the central air-conditioning unit 42. In this way it is possible to deliver to the compartment 34 air which is at a lower temperature than that of the room air.

It can be advantageous to control the apparatus by automatic means in such a manner that the temperature and moisture content in the spinning rotor is maintained at a predetermined constant level or value.

Although the illustrated exemplary embodiment has been described in conjunction with a central air-conditioning unit 42 serving to climatize the entire spinning room and at which all spinning machines are connected via the conduit 40, instead of this arrangement it would be possible to provide for each spinning machine an air conveying- or conditioning unit.

While there is shown and described present preferred embodiments of the invention, it is to be distinctly understood that the invention is not limited thereto but may be otherwise variously embodied and practiced within the scope of the following claims. Accordingly,

What is claimed is:

1. A method for influencing the ambient conditions prevailing at the spinning location during open-end spinning, comprising the steps of delivering fibers by means of a conveying air stream to a spinning rotor, spinning the fibers into a yarn at such rotor, cooling the rotor by simultaneously delivering to the spinning rotor a flowing cooling air stream which is separate from the conveying air stream for the fibers, and providing separate and independent flow paths at least at the region of the rotor for the conveying air stream and cooling air stream respectively, in order to control the climatic conditions at which spinning of the fibers occurs, to thereby minimize rupture of the spun yarn.

2. The method as defined in claim 1, further including the step of using artificially conditioned air to form the conveying air stream for the fibers.

3. The method as defined in claim 1, including the step of removing heat produced by friction from the spinning rotor by the cooling thereof.

4. An apparatus for influencing the ambient conditions of open-end spinning equipment, comprising a spinning rotor for spinning fibers delivered thereto by means of a conveying air stream, means for delivering fibers by means of a conveying air stream to one side of the spinning rotor, means providing at least one outlet opening at the spinning rotor for the conveying air stream, means providing a compartment for the side of said spinning rotor which is not impinged by the conveying air stream for the fibers, said compartment being provided with at least one inflow opening and at least one outflow opening for cooling air for cooling of said spinning rotor, an air conveying mechanism, said inflow opening for the cooling air being different than said outlet opening for the conveying air stream, and means for connecting said outflow opening with said air conveying mechanism.

5. The apparatus as defined in claim 4, wherein said air conveying mechanism constitutes a component of an air-conditioning unit, said air-conditioning unit having a suction side, and said connecting means comprising a conduit for connecting said suction side of said air-conditioning unit with said compartment.

6. The apparatus as defined in claim 5, further including bearing means for said spinning rotor, said compartment housing said bearing means of said spinning rotor.

7. The apparatus as defined in claim 5, further including a separation mechanism provided for said spinning rotor, and means operatively connecting the suction side of said airconditioning unit with said separation mechanism.

8. The apparatus as defined in claim 7, further including blower air conduit means for connecting said air-conditioning unit with said separation mechanism for delivering artificially conditioned air to the latter.

9. An apparatus for influencing the ambient conditions of open-end spinning equipment, comprising a spinning rotor for spinning fibers delivered thereto by means of a conveying air stream, means for delivering fibers by means of a conveying air stream to one side of the spinning rotor, means providing a compartment for the side of said spinning rotor which is not impinged by the conveying air stream for the fibers, said compartment being provided with at least one inflow opening and at least one outflow opening for cooling air for cooling of said spinning rotor, an air conveying mechanism, means for connecting said outflow opening with said air conveying mechanism, said air conveying mechanism constitutes a component of an air-conditioning unit, said air-conditioning unit having a suction side, said connecting means comprising a conduit for connecting said suction side of said air-conditioning unit with said compartment, means defining an additional compartment communicating with the interior of said spinning rotor, and means for connecting said additional compartment with said conduit which connects said compartment for the non-impinged side of said spinning rotor with said air conveying mechanism.

10. A method for influencing the ambient conditions prevailing at the spinning location during open-end spinning comprises the steps of delivering fibers by means of an artificially conditioned conveying air stream to a spinning rotor, spinning the fibers into a yarn at such rotor, cooling the rotor by simultaneously delivering to the spinning rotor a flowing cooling air stream which is separate from the conveying air stream for the fibers.

11. A method for influencing the ambient conditions prevailing at the spinning location during open-end spinning, comprising the steps of delivering fibers by means of a conveying air stream to a spinning rotor, spinning the fibers into a yarn at such rotor, cooling the rotor by simultaneously delivering to the spinning rotor a flowing cooling air stream which is separate from the conveying air stream for the fibers.

12. In an apparatus for open-end spinning, comprising: a housing; a spinning chamber defined within the housing; a power driven rotor within the chamber; a feeder channel for feeding discrete fibers to the interior of the rotor by means of a current of air; a fiber receiving groove in the interior of the rotor; a thread evacuation channel for conducting twisted thread from the fiber groove out of the spinning chamber; and at least one air passage in the rotor connecting the interior of the rotor with an adjoining area of the spinning chamber; the chamber having at least one air outlet opening, the improvement wherein the at least one air outlet opening, through which air flowing into the interior of the rotor leaves the spinning chamber, is connected to an air suction device by at least one air channel, and wherein the wall of the spinning chamber defined by the housing is provided with at least one bypass inlet opening.

* * * * *